US010945510B2

(12) United States Patent
Wolfe et al.

(10) Patent No.: US 10,945,510 B2
(45) Date of Patent: Mar. 16, 2021

(54) COSMETIC CONTAINER WITH MAGNETIC CLOSURE

(71) Applicant: Cosmopak U.S.A. LLC, Port Washington, NY (US)

(72) Inventors: Daniel Wolfe, New York, NY (US); Matthew Wolfe, New York, NY (US); Barnett Wolfe, Port Washington, NY (US); Walter Dwyer, Pacific Palisades, CA (US)

(73) Assignee: COSMOPAK U.S.A. LLC, Port Washington, NY (US)

( * ) Notice: Subject to any disclaimer, the term of this patent is extended or adjusted under 35 U.S.C. 154(b) by 236 days.

(21) Appl. No.: 16/218,263

(22) Filed: Dec. 12, 2018

(65) Prior Publication Data

US 2019/0239618 A1 Aug. 8, 2019

Related U.S. Application Data

(60) Provisional application No. 62/628,128, filed on Feb. 8, 2018.

(51) Int. Cl.
*A45D 34/04* (2006.01)
*B65D 51/32* (2006.01)

(52) U.S. Cl.
CPC ..... *A45D 34/046* (2013.01); *B65D 51/32* (2013.01); *A45D 2200/051* (2013.01); *B65D 2313/04* (2013.01)

(58) Field of Classification Search
CPC .... B65D 2313/04; B65D 51/32; B65D 65/38; B65D 69/00; B65D 71/00; B65D 77/245; A45D 34/046; A45D 2200/051; A45D 40/22
USPC ..... 220/230, 736
See application file for complete search history.

(56) References Cited

U.S. PATENT DOCUMENTS

| | | | | |
|---|---|---|---|---|
| 6,732,743 | B1 | 5/2004 | Bouix et al. | |
| 8,534,946 | B2 | 9/2013 | Cont | |
| 8,556,527 | B1 * | 10/2013 | Chou | A45D 40/04 401/98 |
| 10,058,160 | B2 | 8/2018 | Chen | |
| 2009/0110464 | A1 | 4/2009 | Zhang | |
| 2012/0301206 | A1 * | 11/2012 | Pires | A45D 40/265 401/122 |
| 2015/0110539 | A1 | 4/2015 | Huang | |
| 2018/0235346 | A1 | 8/2018 | Chen et al. | |

FOREIGN PATENT DOCUMENTS

| | | |
|---|---|---|
| CN | 202514864 | 11/2012 |
| DE | 20 2017 100 438 U1 † | 3/2017 |
| WO | 2016/203143 A1 † | 12/2016 |

* cited by examiner
† cited by third party

*Primary Examiner* — King M Chu
(74) *Attorney, Agent, or Firm* — Holzer Patel Drennan

(57) ABSTRACT

A cosmetic container with a self-aligning magnetic closure. The cosmetic container can include a cap with a first magnetic portion and an applicator including a plug, and a receptacle for receiving product therein, the receptacle having a second magnetic portion configured to engage with the first magnetic portion, and an access aperture configured to receive the applicator. In some implementations, one of the cap or the receptacle includes at least one cam feature and the other of the cap or the receptacle includes at least one recess configured to receive the at least one cam feature.

19 Claims, 12 Drawing Sheets

COSMETIC CONTAINER WITH MAGNETIC CLOSURE

CROSS-REFERENCE

This application claims priority to and the benefit under to 35 U.S.C. 119(e) to U.S. provisional application 62/628,128, filed Feb. 8, 2018 and entitled "Cosmetic Container with Self-Aligning Magnetic Closure," the entire disclosure of which is incorporated herein by reference for all purposes.

BACKGROUND

Containers, such as cosmetic containers containing lip gloss, mascara, eye liner, concealer, creams, gels, or other similar products, may include two components that attach to one another for closure, where one component has an applicator for applying the cosmetic that is received in the other component, such as a vial, containing product. The two components are joined at a closure. A seal in the closure of the cosmetic containers preserves the product in the vial, which in some cases, may be of high value. In one example, one component may have a threaded neck on one end and the other component has mating threads so that it can repeatedly screw on and off during use.

SUMMARY

The disclosed technology includes a cosmetic container with a self-aligning sealing system between two components of the container. The cosmetic container may be used for storing various products, such as lip gloss, mascara, eye liner, concealer, creams, or gels. Specifically, the cosmetic container includes a first component having a body configured to store a cosmetic and a first magnet, wherein the body includes an open end providing access to a product in the interior of the body. The cosmetic container also includes a second component having a cap and a second magnet configured to engage with the first magnet. In some implementations, the cap includes an inner cap and/or an applicator, optionally with a plug. In some implementations, the body includes a collar and/or a wiper, with the applicator accessing the interior of the body via the wiper. In some implementations, the interface between the inner cap and the body includes at least one structural feature, such as a cam feature, which upon rotation of the cap in relation to the body, forces separation of the two components thus releasing or at least reducing the engagement between the magnets.

The disclosure provides, in one implementation, a container comprising a receptacle and a cap for engagement with the receptacle. The receptacle has an interior volume, an access aperture providing access to the interior volume, an abutment surface around the access aperture, and a first magnetic portion present on the abutment surface. The cap repeatedly provides and inhibits access to the interior volume, the cap having a second magnetic portion having an opposite polarity than the first magnetic portion. One of the receptacle or the cap has at least one cam feature and the other of the receptacle or cap has at least one recess for each cam feature for receiving the cam feature.

This disclosure also provides, in one implementation, a container comprising a receptacle and cap for engagement with the receptacle. The receptacle has an access aperture providing access to an interior volume of the receptacle, the receptacle further having a first magnetic portion at an abutment surface of the receptacle. The cap has a second magnetic portion at an abutment surface of the cap, the cap and the receptacle forming a seal when the abutment surface of the cap is held in contact with the abutment surface of the receptacle by an attractive magnetic force between the first magnetic portion and the second magnetic portion. Rotation of the cap in relation to the receptacle mechanically separates the abutment surface of the cap from the abutment surface of the receptacle, decreasing the attractive magnetic force between the first magnetic portion and the second magnetic portion and breaking the seal.

This disclosure also provides, in one implementation, a container comprising a receptacle and a cap for engagement with the receptacle. The receptacle has an interior volume, an access aperture providing access to the interior volume, an abutment surface around the access aperture, and a first magnetic portion present on the abutment surface. The cap repeatedly provides and inhibits access to the interior volume, and has a male portion extending from the cap, the male portion receivable into the access aperture of the receptacle, and a second magnetic portion present around the male portion, the second magnetic portion having an opposite polarity than the first magnetic portion.

This disclosure also provides a method for closing a container, the method including aligning a first magnetic portion of a first component of the container to an opposing second magnetic portion of a second component of the container with opposite polarity, aligning a structural feature, such as a cam feature, in the first component to a recess in the second component, slideably attaching the first component to the second component via magnetic forces between the first magnetic portion and the opposing second magnetic portion, and receiving the structural feature into the recess. The disclosure also provides a method for opening the container.

This disclosure also provides a method for closing a container having a receptacle and a cap. The method includes aligning a male portion of the cap with an access aperture of the receptacle, the access aperture providing access to an interior volume of the receptacle, the receptacle having a first magnetic portion around the access aperture and the cap having a second magnetic portion around the male portion, inserting the male portion at least partially into the interior volume, and thus attaching the cap to the receptacle via magnetic forces between the first magnetic portion and the second magnetic portion to provide a seal between the cap and the receptacle. The disclosure also provides a method for opening the container.

This Summary is provided to introduce a selection of concepts in a simplified form that are further described below in the Detailed Descriptions. This Summary is not intended to identify key features or essential features of the claimed subject matter, nor is it intended to be used to limit the scope of the claimed subject matter. These and various other features and advantages will be apparent from a reading of the following Detailed Descriptions.

BRIEF DESCRIPTIONS OF THE DRAWING

The described technology is best understood from the following Detailed Description describing various implementations read in connection with the accompanying drawing.

Figure 4A:
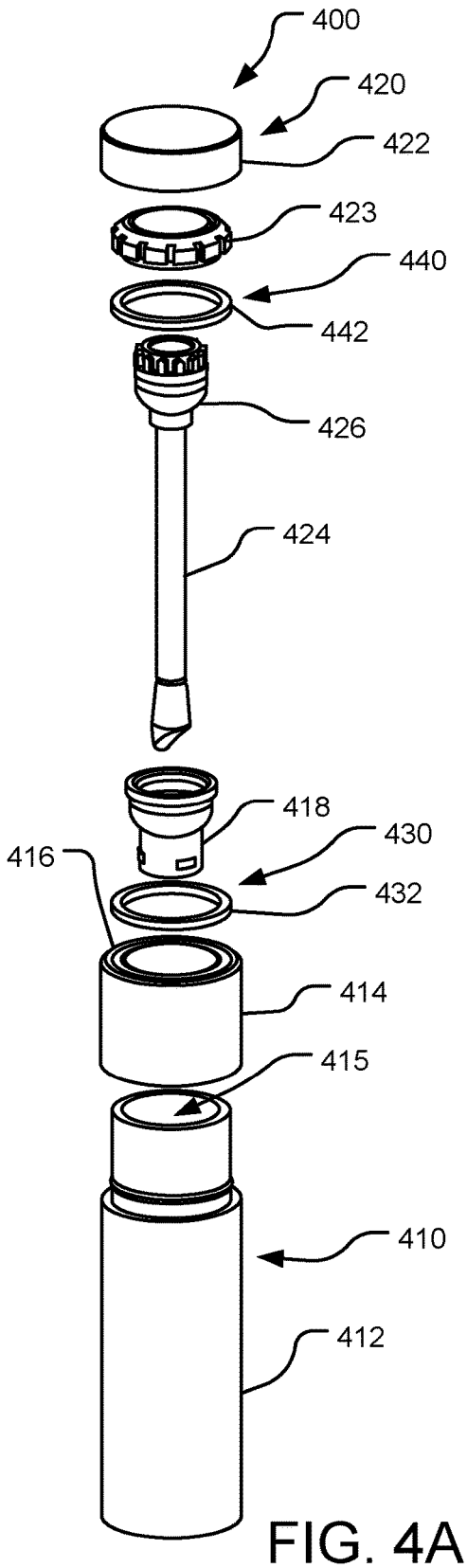
Figure 4B:
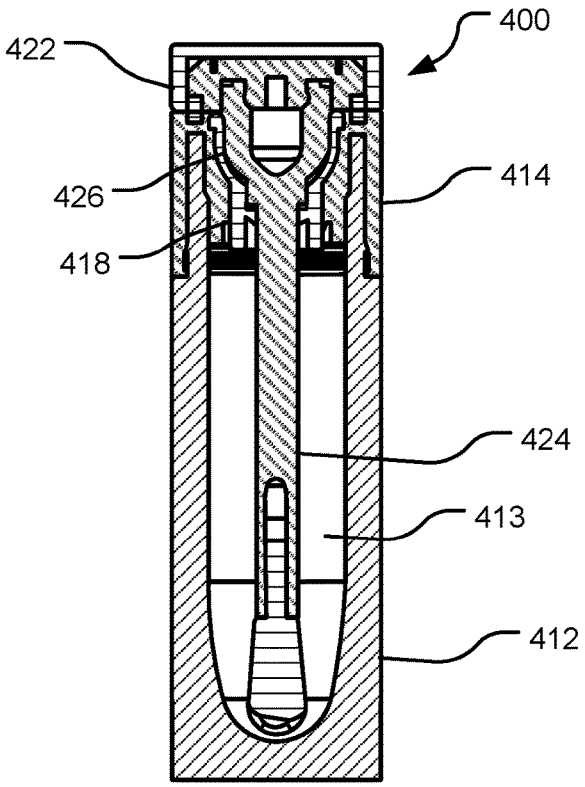
Figure 4C:
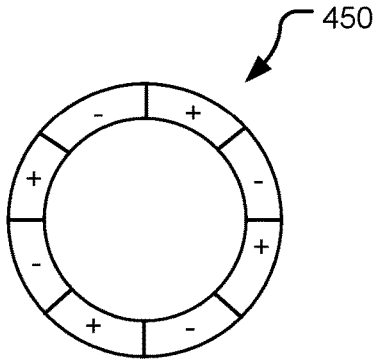

FIG. 4A is an exploded perspective view of another example of a cosmetic container; FIG. 4B is a cross-sectional side view of the cosmetic container; FIG. 4C is a top plan view of a continuous magnet having alternating polarities.

Figure 5A:
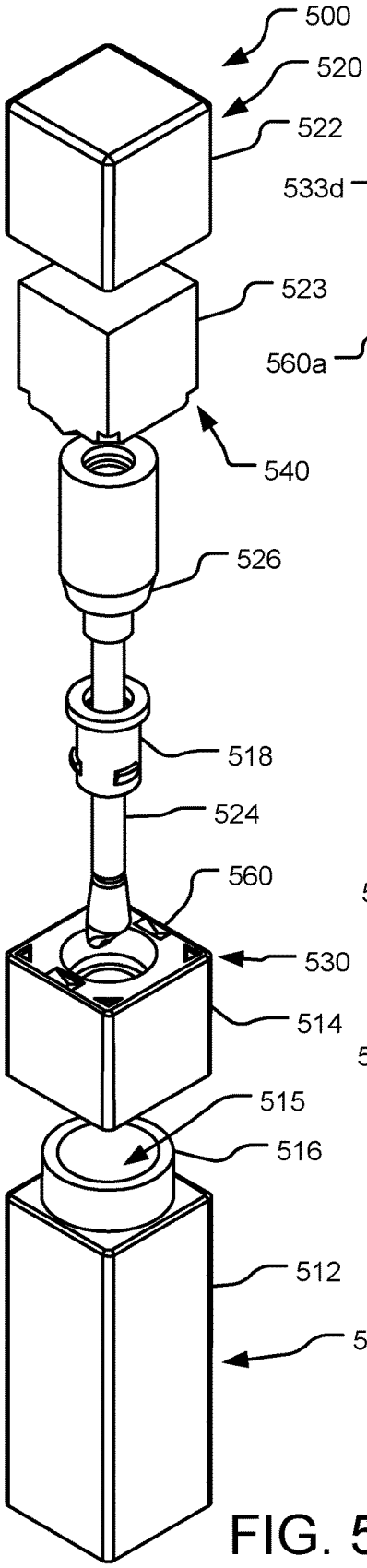
Figure 5B:
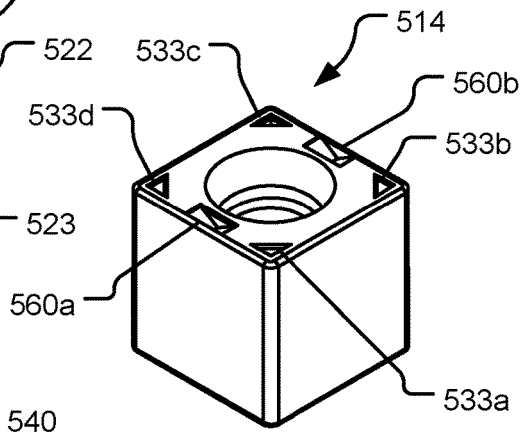
Figure 5C:
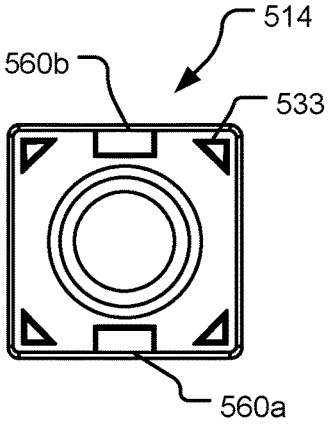
Figure 5D:
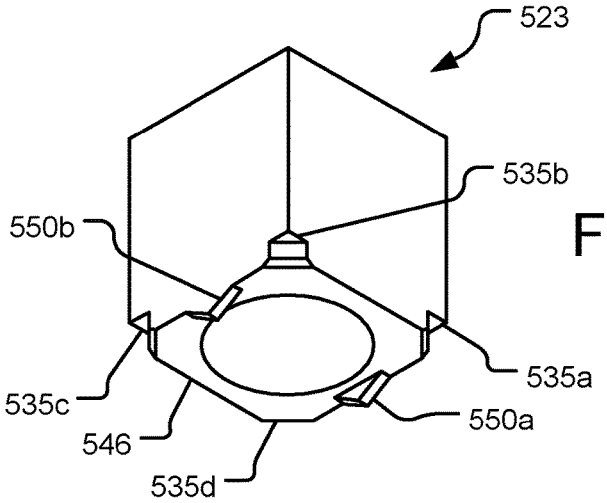
Figure 5E:
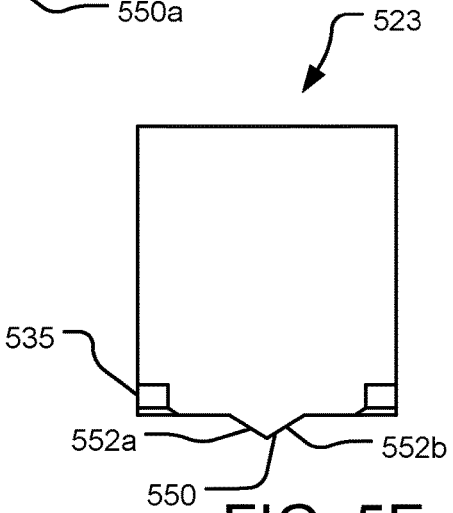

FIG. 5A is an exploded perspective view of an example cosmetic container; FIG. 5B is a perspective view of a collar of the cosmetic container; FIG. 5C is a plan view of the top of collar; FIG. 5D is a perspective view of an inner cap of the cosmetic container; FIG. 5E is a plan view of the side of the inner cap.

Figure 6A:
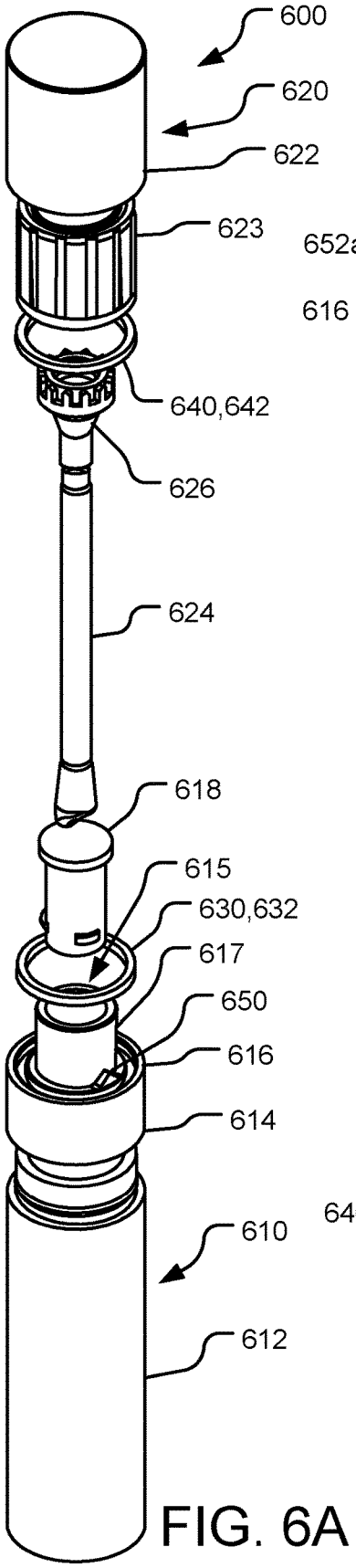
Figure 6B:
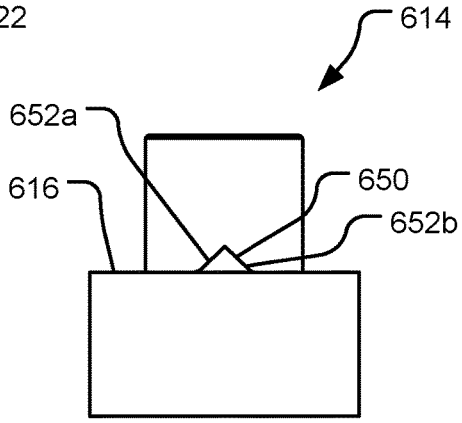
Figure 6C:
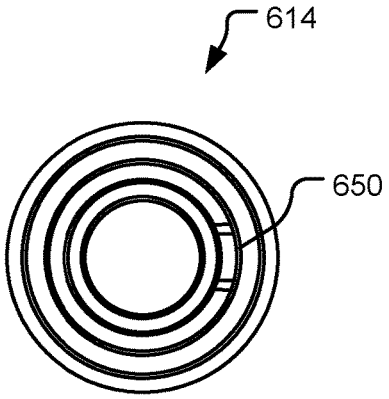
Figure 6D:
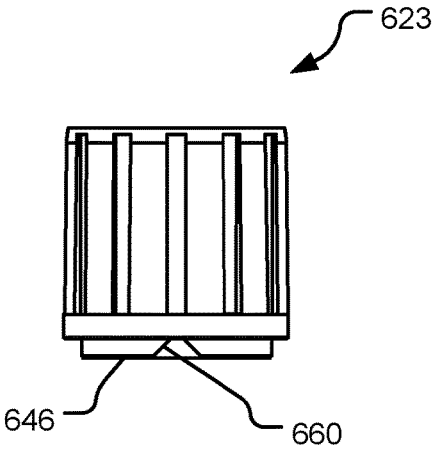
Figure 6E:
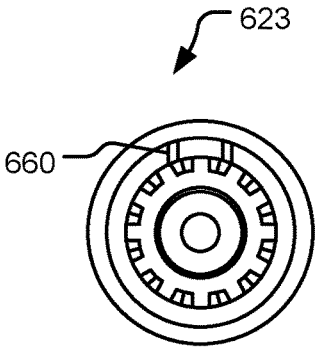

FIG. 6A is an exploded perspective view of another example cosmetic container; FIG. 6B is a plan view of the side of a collar of the cosmetic container; FIG. 6C is a plan view of the top of the collar; FIG. 6D is a plan view of the side of an inner cap of the cosmetic container; FIG. 6E is a plan view of the bottom of the inner cap.

Figure 7A:
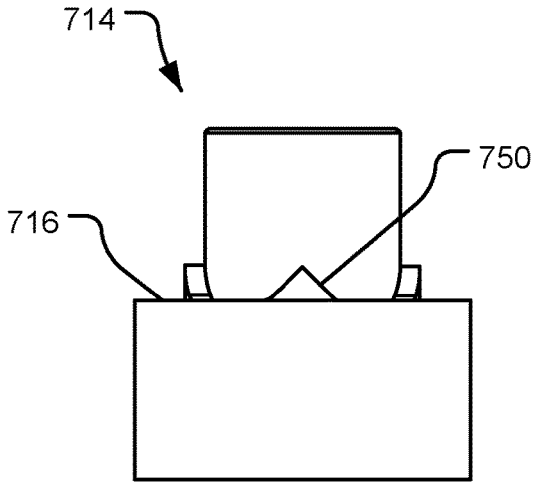
Figure 7B:
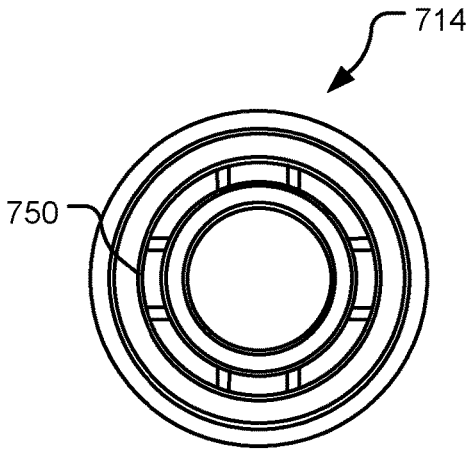
Figure 7C:
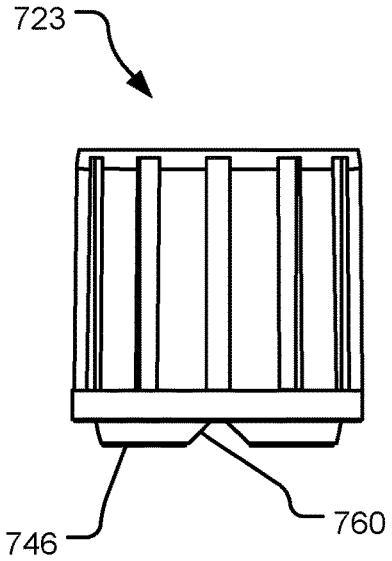
Figure 7D:
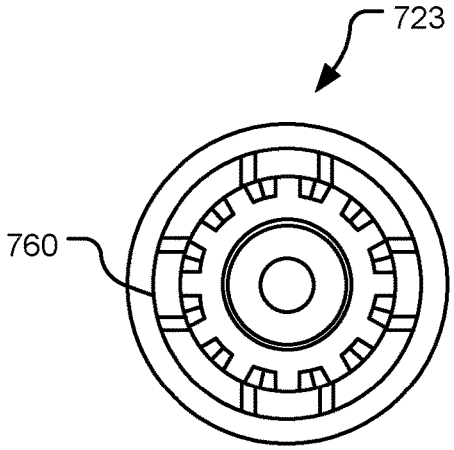

FIG. 7A is a plan view of the side of a collar of another example cosmetic container; FIG. 7B is a plan view of the top of the collar; FIG. 7C is a plan view of the side of an inner cap of the cosmetic container; FIG. 7D is a plan view of the bottom of the inner cap.

Figure 8A:
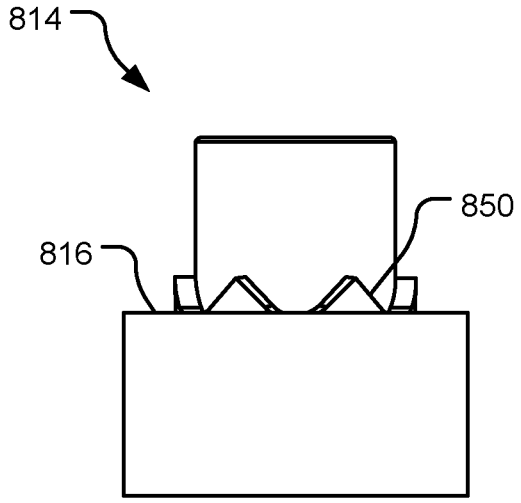
Figure 8B:
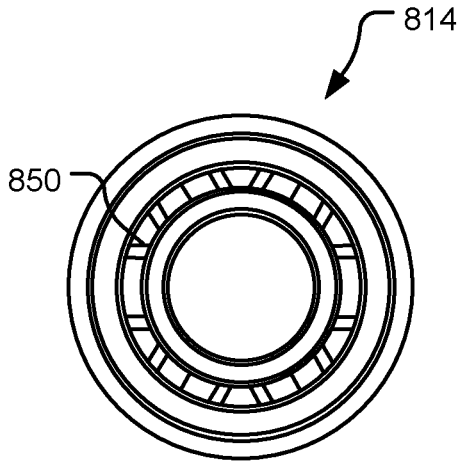
Figure 8C:
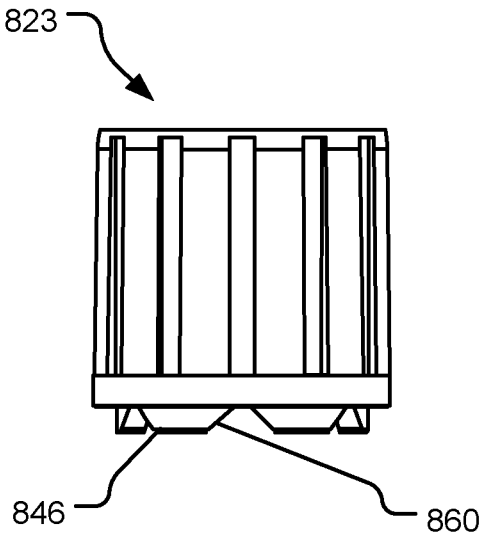
Figure 8D:
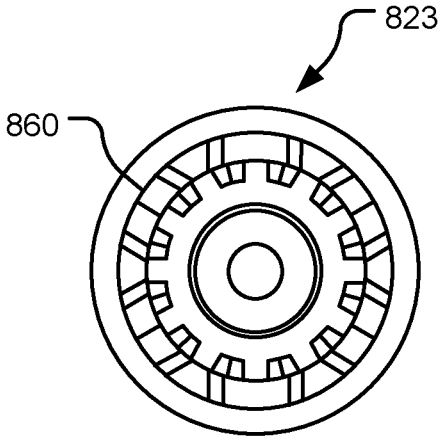

FIG. 8A is a plan view of the side of a collar of another example cosmetic container; FIG. 8B is a plan view of the top of the collar; FIG. 8C is a plan view of the side of an inner cap of the cosmetic container; FIG. 8D is a plan view of the bottom of the inner cap.

Figure 9:
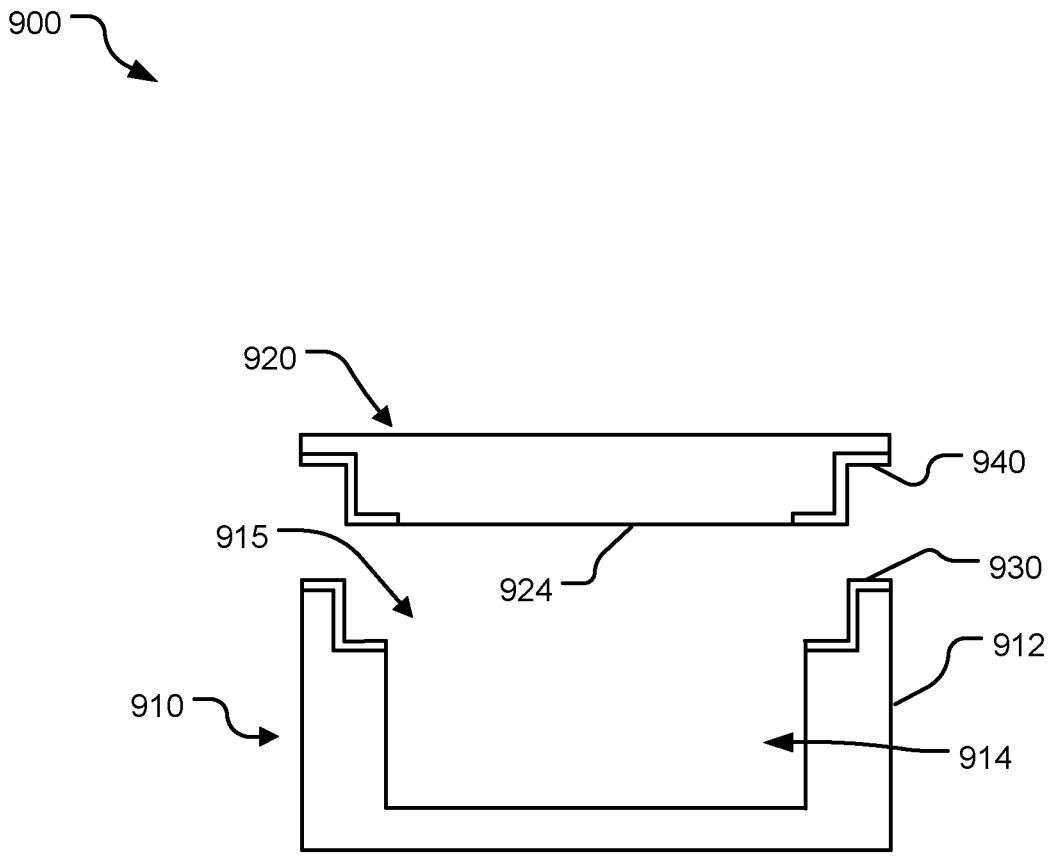

FIG. 9 is a schematic cross-sectional side view of another example cosmetic container.

Figure 10:
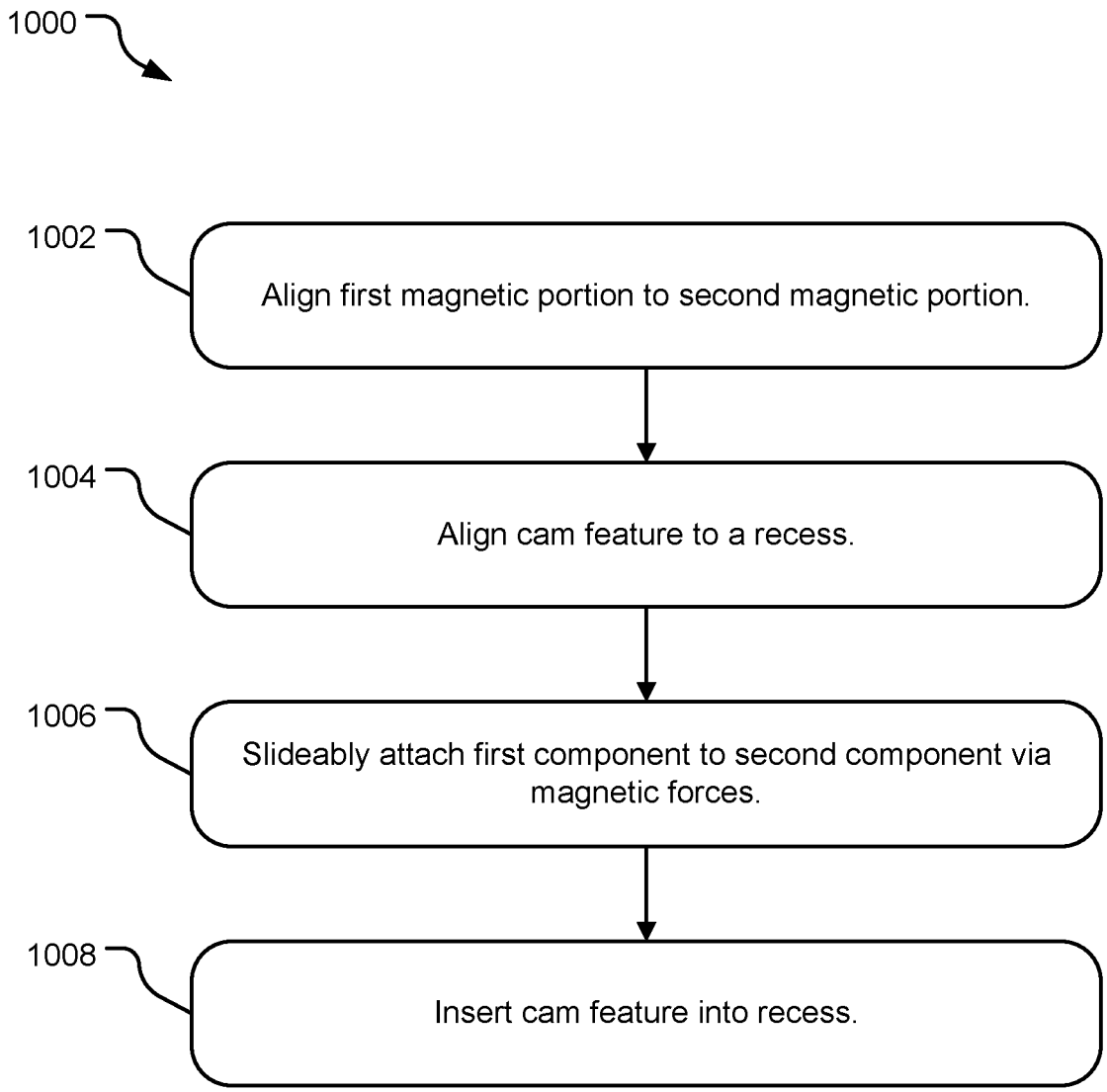

FIG. 10 is a flowchart for an example method of closing a container.

Figure 11:
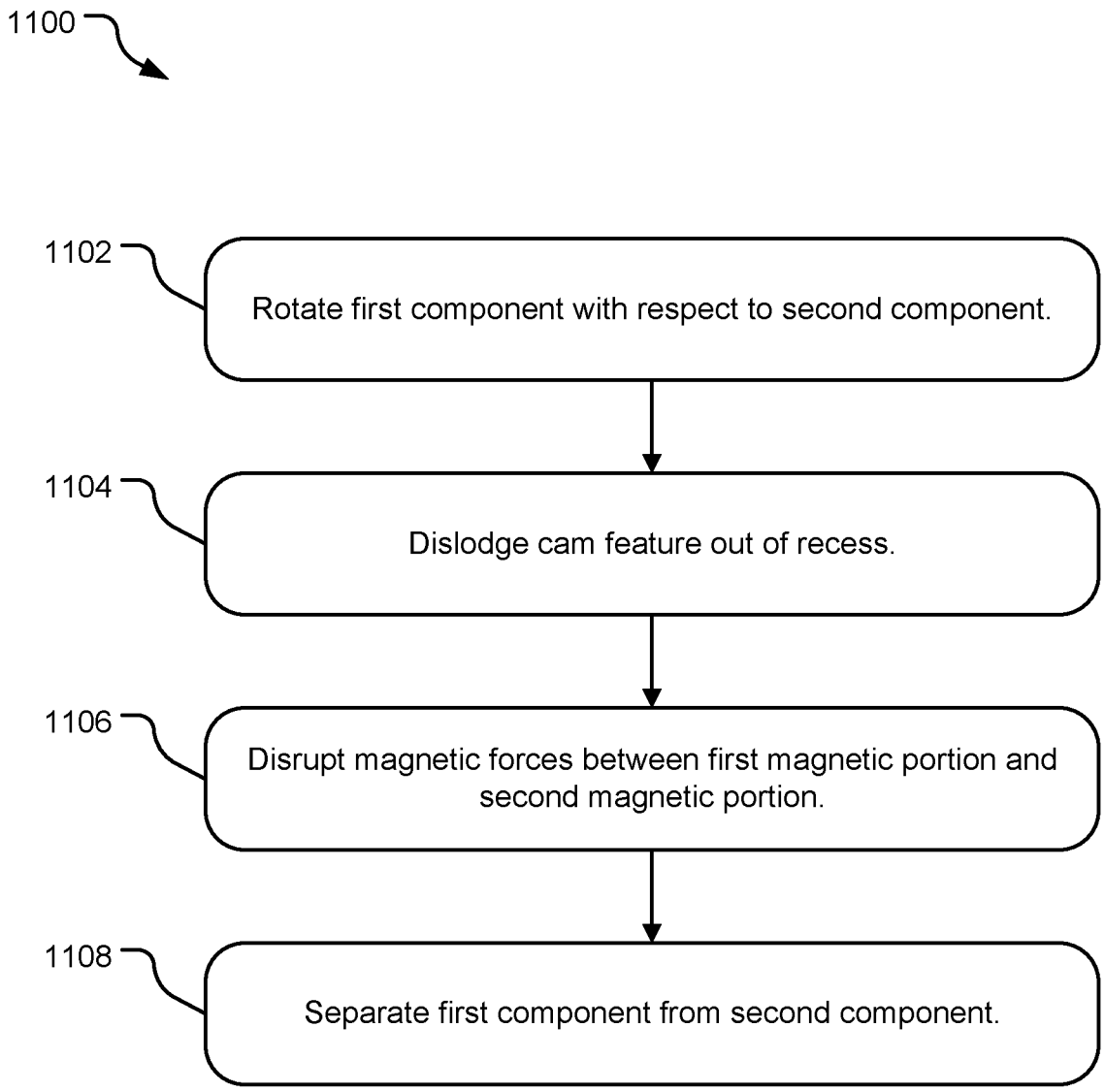

FIG. 11 is a flowchart for an example method of opening a container.

Figure 12:
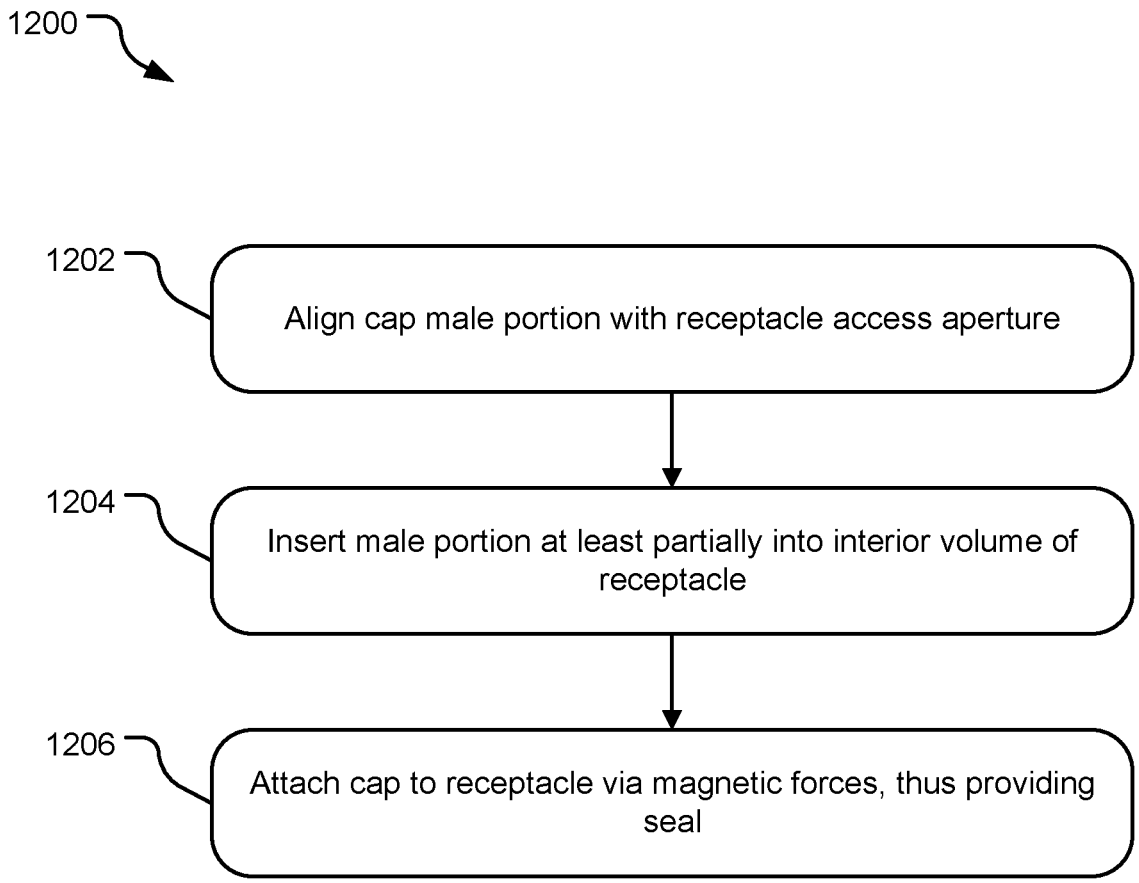

FIG. 12 is a flowchart for another example method of closing a container.

DETAILED DESCRIPTION

As indicated above, containers, such as cosmetic containers may include two components that attach to one another for closure, where one component has an applicator for applying the cosmetic that is received in the other component, with the two components joinable at a closure. Upon opening the cosmetic container, as one component is disengaged from the other component, an applicator, such as for lip gloss, may be pulled out of the one component with product on the applicator for use.

The disclosed technology includes a container that may be used for storing various cosmetic products, such as lip gloss, mascara, eye liner, eye shadow, concealer, creams, or gels. In some implementations, the container may be used for non-cosmetic products, such as dental or oral care products, skin ointments, glue, touch-up paint, ink, paste, oils, etc. Typically, the product stored within the container is a liquid, semi-liquid, paste, gel, etc., although depending on the product and the configuration of the container, the product may be a solid, e.g., in powder form.

The cosmetic container includes a first component (e.g., a receptacle) including a body to receive the cosmetic product and a first magnetic portion, and a second component including a cap to provide access to the cosmetic product in the receptacle and also inhibit access to the cosmetic product, and a second magnetic portion configured to releasably engage with the first magnetic portion. The first component and the second component, when engaged via the first magnetic portion with the second magnetic portion, have a magnetic seal therebetween, in some implementations a fluid-tight seal. The first component and the second component are configured to have the first component (e.g., receptacle) receiving a portion of the second component (e.g., the cap); the components can be referred to as having a male/female relationship, with the first component (e.g., receptacle) being the female component, receiving therein a portion of the second, male, component (e.g., cap).

The container can be referred to as a vial, tub, jar, cup, or any other container having two components that retains a liquid, semi-liquid, gel, paste, gel, cream or other form of cosmetic therein. These containers conventionally have a threaded or screwed attachment between the two components. However the magnetic seal formed by the first magnetic portion and the second magnetic portion of this disclosure, together with additional, optional elements, provides a fluid-tight seal without a mechanical engagement such as threads. Due to the magnetic closure features, in some implementations, the cosmetic container does not need or have a neck, e.g., on the receptacle. In contrast, for a cosmetic container that includes a screw top with threads, a neck is required.

As indicated above, the container includes a first component that contains and retains the cosmetic product and a second component that repeatedly provides access to and inhibits (e.g., closes) access to the cosmetic product. In some implementations, the cosmetic container includes a first component (receptacle) having a body with an interior volume to receive the cosmetic product, a collar including a wiper, and a first magnetic portion, and a second component including a cap, an applicator, and a second magnetic portion configured to releasably engage with the first magnetic portion. The first magnetic portion and the second magnetic portion provide a strong and controlled closure of the cosmetic container; the male/female engagement of the cap and receptacle may increase the strength of the magnetic closure seal. The magnetic portions, in some implementations, may provide a "click" or "snap", indicating that the components are aligned and sealed.

Magnets form a circuit between poles of opposite polarity (e.g., north poles and south poles), with magnetic flux from one pole seeking the opposite pole. Flux lines seek the lowest energy path from one pole to the other pole, e.g., from north to south poles. An entire magnet may have one polarity. Alternately, patterns of polarity can be engineered on a surface of a magnet to control the shape of the circuit and the path of the magnetic flux.

Either of the magnetic portions on the cosmetic container can be a single magnet or a plurality of individual magnets, e.g., evenly spaced. The magnets may be any conventional magnet, e.g., iron, iron alloy, nickel, cobalt, rare earth magnet, etc. Examples of rare earth magnets include SmCo and NdFeB. The magnets may be smart, programmed, or engineered magnets (e.g., Polymagnet®), including those having patterns of alternating polarity. In an engineered magnet, a series of magnetic patterns focus magnetic energy to produce greater holding forces and direct magnetic energy to create magnets with alignment, spring, or latch features. The magnets may have any suitable shape including, e.g., square, triangular, elongate, circular, and annular. As one example, circular magnets of 1.8 mm may be used.

Neodymium-based magnets (e.g., NdFeB) have their strength correlated to the material grade of the magnet, which is reported as "N". Neodymium magnets of 27N to 52N may be used for the cosmetic containers of this disclosure, although in some implementations ranges of 35N to 48N, in other implementations 40N to 45N, may be used.

In some engineered magnets, a positive force moves the magnets closer to each other and a negative force moves the magnets away from each other. Thus, misalignment of the magnets creates displacement as the negative force repels the magnets. The self-aligning features provide a stronger magnet in a limited volume and a controlled closure as the first component and the second component come together. Such magnets may be utilized in the first component and the second component of the cosmetic container to control alignment and facilitate opening and closing in specific orientations.

The magnets provide the cosmetic container with a self-aligning enclosure. The self-aligning enclosure may be facilitated by the magnetic forces of the first magnetic portion and the second magnetic portion holding the first component (receptacle) and the second component (cap) together only under specific orientations. For example, as a container is being closed by a user, a first magnet on a first component may self-align to an opposing second magnet on a second component of opposite polarity. If a user is attempting to close a cosmetic container by aligning a first magnet on the first component to an opposing second magnet of the same polarity on the second component, the enclosure will not align, as the magnets may repel the first component and the second opponent away from each other.

In some implementations, the magnetic field strength of the first magnetic portion and/or the second magnetic portion is at least 10 kOe, in some implementations at least 11 kOe, and in other implementations at least 13 kOe.

In the following description, reference is made to the accompanying drawing that forms a part hereof and in which is shown by way of illustration at least one specific implementation. The following description provides additional specific implementations. It is to be understood that other implementations are contemplated and may be made without departing from the scope or spirit of the present disclosure. The following detailed description, therefore, is not to be taken in a limiting sense. While the present disclosure is not so limited, an appreciation of various aspects of the disclosure will be gained through a discussion of the examples, including the figures, provided below. In some instances, a reference numeral may have an associated sub-label consisting of a lower-case letter to denote one of multiple similar components. When reference is made to a reference numeral without specification of a sub-label, the reference is intended to refer to all such multiple similar components.

Figure 1:
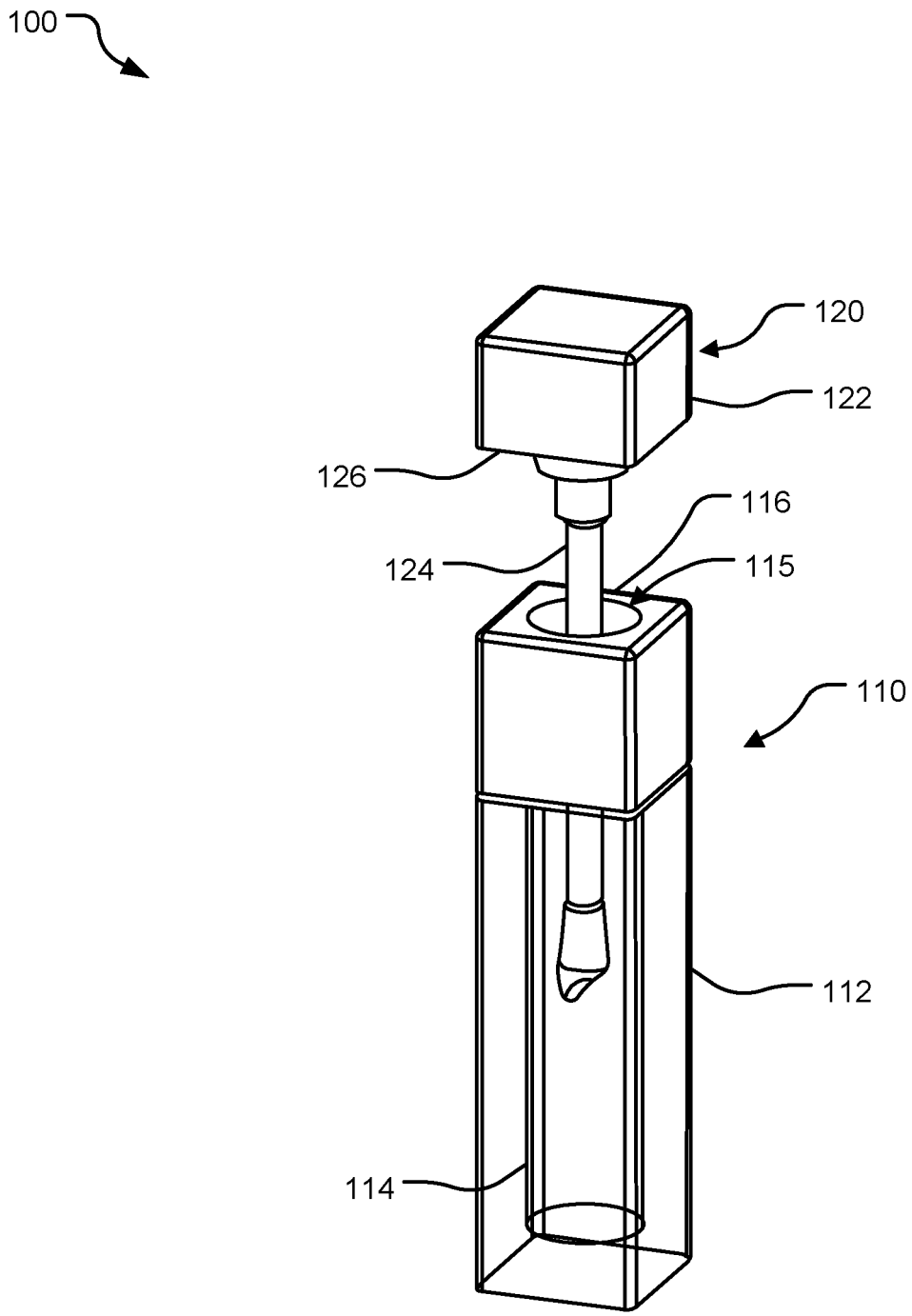
FIG. 1 is perspective view of an example cosmetic container.

Referring to FIG. 1, a generally rectangular cosmetic container 100 is shown, the container 100 having a receptacle 110 and a cap 120 removable and replaceable from the receptacle 110 for providing and inhibiting access to the interior of the receptacle 110, both the receptacle 110 and the cap 120 having a rectangular (e.g., square) cross-sectional shape. The receptacle 110 has a body 112 defining an interior volume 114 for receiving a product, e.g., a cosmetic, therein and includes an access 115 for providing access to the interior volume 114. The receptacle 110 has a first magnetic portion 116 of a magnetic sealing system, which is described in detail below. The cap 120 has an outer portion 122 by which a user can grasp the cap 120, an applicator wand 124 extending from the cap, and a second magnetic portion 126 of the magnetic sealing system. When the receptacle 110 and the cap 120 are engaged, with the wand 124 of the cap 120 inserted into the interior volume 114 of the receptacle 110 (thus, the cap 120 being a male structure being received in the female receptacle 110), the first magnetic portion 116 and the second magnetic portion 126 of the magnetic sealing system releasably engage with each other, and together with other features discussed below, provide a fluid-tight seal between the receptacle 110 and the cap 120.

Figure 2A:
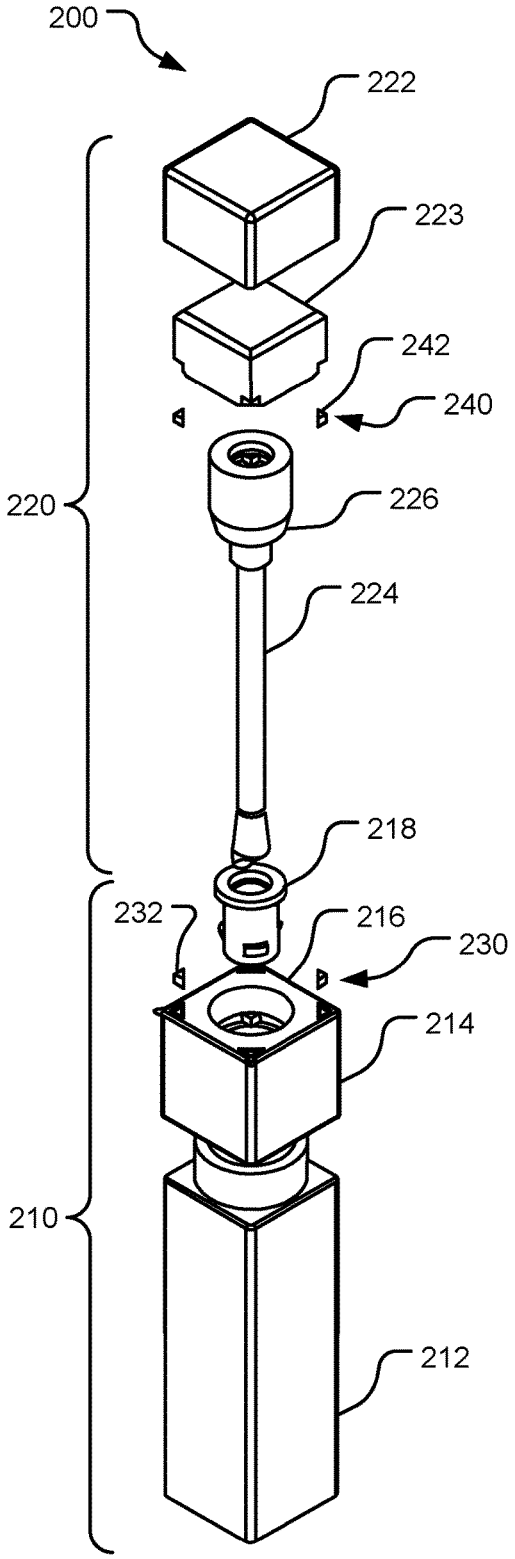
FIG. 2A is an exploded perspective view of an example cosmetic container.
Figure 2B:
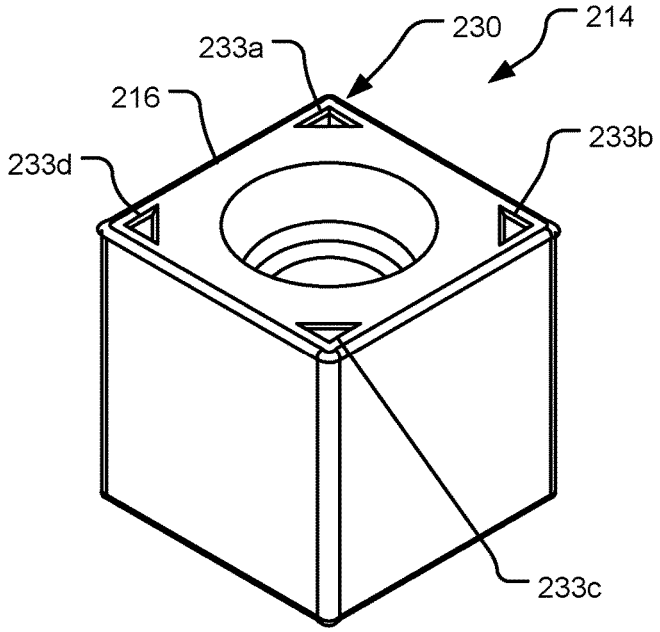
FIG. 2B is a perspective view of the collar of the cosmetic container.

Turning to FIG. 2A and to FIG. 2B, an exploded view of a rectangular cosmetic container 200, having a square cross-sectional shape and similar to the cosmetic container 100 of FIG. 1, is shown.

The container 200 has a receptacle 210 having a body 212 defining an interior volume (not seen in FIG. 2A or FIG. 2B), a collar 214 having an access aperture providing access to the interior volume, an abutment surface 216, and a wiper insert 218. The wiper 218 can have a tapered, e.g., cone-shaped component built into the wiper 218 to control the amount of product that is transported out of the interior volume. The wiper 218 may also assist in sealing the cosmetic container for air tightness. The receptacle 210 includes, in this implementation as part of the collar 214, a first magnetic portion 230 of a magnetic sealing system present on the abutment surface 216.

The container 200 also has a cap 220 that is repeatedly removable and replaceable onto the receptacle 210 to provide access to (e.g., open), and to inhibit access to (e.g., close), the interior volume of the receptacle 210. The cap 220, in FIG. 2A, includes an outer cap 222, an inner cap 223 and an applicator wand 224 extending from the caps 222/223. The interior volume of the receptacle 210 receives a rod portion of the applicator wand 224 during use and houses the rod portion in a closed position. The applicator wand 224 may have a brush, pad, bristles, teeth, or similar component on the end thereof. The inner cap 223 may be, e.g., adhesively adhered to, be connected via a friction fit, or mechanically interlocked with the outer cap 222. Connection of the applicator wand 224 to the caps 222/223 is via a plug 226 configured to seat against the abutment surface 216 of the collar 214 and optionally the wiper 218 of the receptacle 210 to form a seal. The plug 226 has a greater diameter than the wiper 218 and may be rigid (e.g., a hard plastic) or may be compressible (e.g., foam or rubber).

During use, as the applicator wand 224 is axially withdrawn from the receptacle 210 through the collar 214 and the wiper 218, the wiper 218 may remove excess cosmetic product from the wand 224 to decrease the amount of product being withdrawn, e.g., to provide an approximate dose and/or to inhibit potential splattering of the product; the wiper 218 may be rigid (e.g., a hard plastic) or may be compressible (e.g., foam or rubber). The cap 220 also includes, in this implementation as part of the inner cap 223, a second magnetic portion 240 of the magnetic sealing system; it is noted that the second magnetic portion 240 is not readily seen in this view of the cap 220.

The first magnetic portion 230 of the receptacle 210 and the second magnetic portion 240 of the cap 220 form the magnetic sealing system of the container 200. The plug 226 of the cap 220, when in contact with the abutment surface 216 and optionally with the wiper 218, may improve the sealing system. The wiper 218 may assist in sealing the cosmetic container for fluid tightness, e.g., by having the plug 226 seat against and optionally seat at least partially into the center volume of the wiper 218, in a male (plug 226)-female (wiper 218) relationship. Together, the magnetic portions 230, 240 and the wiper 218 and/or the plug 226 provide a sealing system that, when engaged, provides a fluid-tight seal.

Each of the first magnetic portion 230 and the second magnetic portion 240 includes at least one magnet, in this implementation of container 200 each of the first magnetic portion 230 and the second magnetic portion 240 includes four magnets equally distributed around the collar 214 and the cap 220. FIG. 2B illustrates the collar 214 of the receptacle 210, detailing the first magnetic portion 230, which has four individual magnets; in FIG. 2B, four individual receptacles 233*a*, 233*b*, 233*c*, 233*d* are shown in the collar 214, each receptacle 233 for receiving a magnet 232 therein. The receptacle 233 is such that a magnet 232 seated therein is flush with the abutment surface 216. The second magnetic portion 240 on the cap 220 also includes four magnets 242 (two of which are seen in FIG. 2A), positioned in the inner cap 223 to be aligned with the magnets 232 when the square cap 220 is properly positioned in relation to the square receptacle 210 with the corners aligned.

The magnets 232 can have an opposite polarity (e.g., positive polarity versus negative polarity; e.g., north polarity versus south polarity) than the magnets 242 in the cap 220, to provide an attractive force between the receptacle 210 and the cap 220; in some implementations, at least 10 kOe. This force between the magnets of the first magnetic portion 230 and the second magnetic portion 240 is sufficiently strong to hold the cap 220 onto the receptacle 210, in a fluid-tight configuration, when the magnets 232 are aligned with the magnets 242 in the cap 220. Having the corners of the square cap 220 aligned with the corners of the square receptacle 210 confirms the magnets of the cap are properly aligned with the magnets on the receptacle. If desired, the magnetic portions 230, 240 can be configured to allow a limited number of connection orientations, e.g., one or two, to provide for alignment or orientation of indicia on the cap 220 in relation to the receptacle 210.

To open the container 200, the cap 220 can merely be pulled axially away from the receptacle 210, thus breaking the attraction between the magnets. Alternately, the cap 220 and/or the receptacle 210 can be rotated in relation to the other, thus tangentially displacing the magnets of the receptacle 210 from the magnets of the cap 220 and decreasing the attraction between the magnets so that the cap 220 can be readily pulled away from the receptacle 210. This rotation may be, e.g., an eighth turn (45 degrees). A quarter turn (90 degrees) will engage the magnet at the next corner, thus, any rotation at quarter turn increments will not release the cap.

In an implementation not illustrated, present between the magnets 232 on the receptacle 210 may be additional magnets of the opposite polarity. For example, if the magnets 232 on the receptacle 210 have a positive polarity, the corresponding magnets 242 on the cap 220 will have a negative polarity in order to be attractive to the magnets 232. The additional magnets (present between the magnets 232) will also have a negative polarity, so that as the cap 220 is rotated, those magnets on the cap will encounter the repulsive force of the same-polarity magnets, thus pushing the cap 220 away from the collar 214 and facilitating the removal of the cap 220 from the receptacle 210.

Figure 3A:
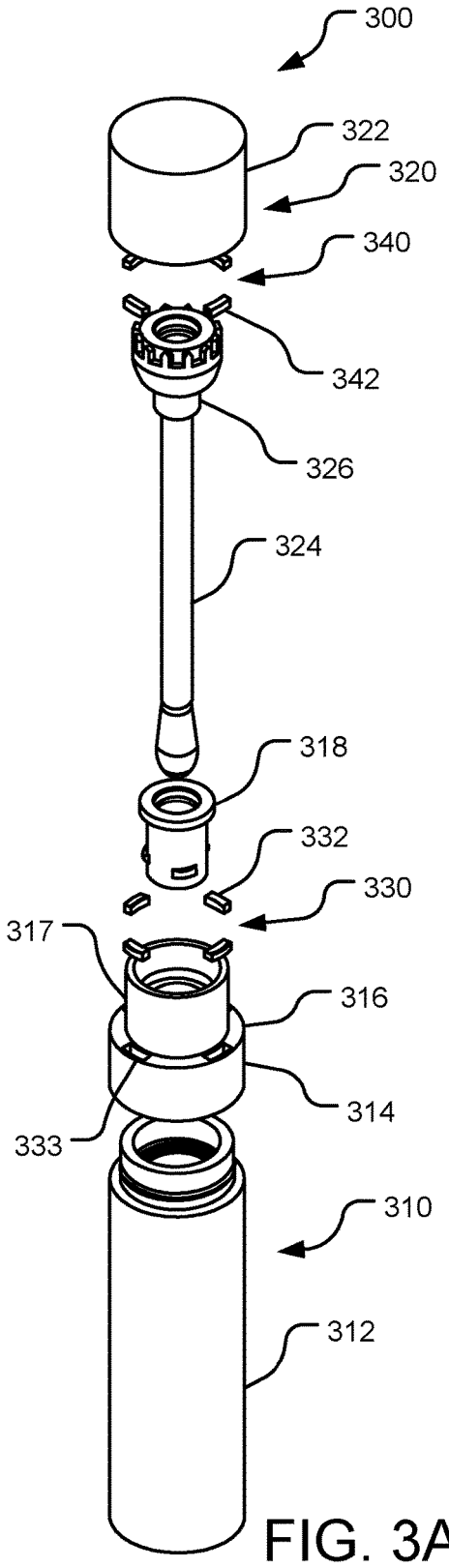
FIG. 3A is an exploded perspective view of another example cosmetic container.
Figure 3B:
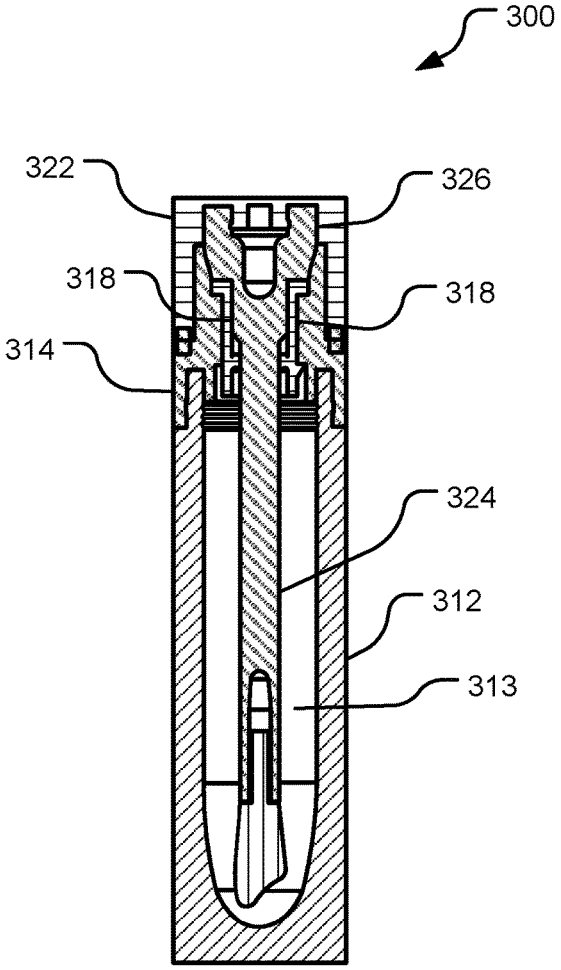
FIG. 3B is a cross-sectional side view of the cosmetic container.

Turning to FIG. 3A and to FIG. 3B, an exploded view of a cylindrical cosmetic container 300 having a circular cross-sectional shape is shown.

Similar to the previous implementations, the container 300 has a receptacle 310 having a body 312 defining an interior volume 313 (FIG. 3B), a collar 314 having an access providing aperture to the interior volume, an abutment surface 316, and a wiper insert 318. In this implementation, extending from the abutment surface 316 is a neck 317 that receives the wiper insert 318. The receptacle 310 includes, in this implementation as part of the collar 314 on the abutment surface 316, a first magnetic portion 330 having at least one magnet 332. In this implementation, four magnets 332 are present and are seated in receptacles 333 in the abutment surface 316.

The container 300 also has a cap 320 that is repeatedly removable and replaceable onto the receptacle 310 to provide access to (e.g., open), and to inhibit access to (e.g., close), the interior volume of the receptacle 310. The cap 320 includes a cap 322 and an applicator wand 324 with a plug 326 extending from the cap 322. The plug 326 is configured to seat against and at least partially into wiper 318, thus providing a male-female interaction between the cap 320 and the receptacle 310. The cap 320 also includes a second magnetic portion 340 of a magnetic sealing system having at least one magnet 342. In this implementation, four magnets 342 are present.

The magnets 342 of the second magnetic portion 340 have an opposite polarity from the magnets 332 of the first magnetic portion 330 in order to provide attractive forces therebetween to form the magnetic sealing system of the container 300. The plug 326 of the cap 320, when in contact with the wiper 318, may improve the sealing system. Together, the magnetic portions 330, 340 and the wiper 318 provide a sealing system that, when engaged, provides a fluid-tight seal.

As with the container 200, to open the container 300, the cap 320 can merely be pulled axially away from the receptacle 310, thus breaking the attraction between the magnets 332, 342. Alternately, the cap 320 and/or the receptacle 310 can be rotated in relation to the other, thus tangentially displacing the magnets of the receptacle 310 from the magnets of the cap 320 and decreasing the attraction between the magnets so that the cap 320 can be readily pulled away from the receptacle 310.

Another exploded view of a cylindrical cosmetic container 400 having a circular cross-sectional shape is shown in FIGS. 4A and 4B. Similar to the cylindrical container 300, the container 400 has a receptacle 410 having a body 412 defining an interior volume 413 (FIG. 4B), a collar 414 having an access 415 providing access to the interior volume, an abutment surface 416, and a wiper insert 418. The receptacle 410 includes, in this implementation as part of the collar 414 on the abutment surface 416, a first magnetic portion 430 having at least one magnet 432. In this implementation, one magnet 432 is present and seated in the abutment surface 416. The magnet 432 is circular or annular, extending continuously and contiguously around the access 415.

The container 400 also has a cap 420 that is repeatedly removable and replaceable onto the receptacle 410. The cap 420 includes an outer cap 422, an inner cap 423 and an applicator wand 424 with a plug 426 extending from the caps 422/423. The cap 420 also includes a second magnetic portion 440 having at least one magnet 442. In this implementation, one circular magnet 442 is present, extending continuously and contiguously around the wand 424.

The magnet 442 of the cap 420 has an opposite polarity from the magnet 432 of the receptacle 410, in order to provide attractive forces therebetween to form the magnetic sealing system of the container 400. The plug 426 of the cap 420, when in contact with the wiper 418, may improve the sealing system. Together, the magnetic portions 430, 440 and the wiper 418 provide a sealing system that, when engaged, provides a fluid-tight seal.

To open the container 400, the cap 420 can merely be pulled axially away from the receptacle 410, thus breaking the attraction between the magnets 432, 442; this is the preferred method for opening the container 400 if magnets 432, 442 have opposite, and thus attracting, polarities the entire length of the magnets 432,442. Rotation of the magnets 432, 442 in relation to each other will not decrease the attraction therebetween, because the magnets 432, 442 have a continuous, opposite polarity the entire length of the magnets 432, 442. However, for those implementations where the magnets 432, 442 do not have the same polarity the entire length of the magnet 432, 442 (but rather, each magnet 432, 442 has both polarities present), rotation of the cap 420 in relation to the receptacle 410 will result in repulsive forces, thus pushing the cap 420 away from the collar 414 and the receptacle 410 and facilitating removal of the cap 420 from the receptacle 410. FIG. 4C illustrates an implementation of a magnet 450 (e.g., either or both magnets 432, 442) having both polarities present. The magnet 450 may be a smart (e.g., Polymagnet®), programmed, or engineered magnet.

FIGS. 5 through 8 provide implementations of cosmetic containers having a magnetic sealing system as described in the examples above, with the addition of a physical structure to facilitate removal of the cap from the receptacle. The physical structural may a cam feature, a tooth, a detent, a protrusion, a tab, or other such extending structure.

Either of the receptacle or the cap may include at least one cam feature and the other of the receptacle or the cap may include at least one recess or cavity for each cam feature present. For example, a collar of the receptacle may include a plurality of recesses or cavities configured to receive a plurality of cam features present on the cap, e.g., inner cap. In some implementations, there may be two, four or five cam features, but other numbers are contemplated depending on the implementation and the size of the cap and the collar.

The cam features and recesses assist in alignment of the cap and receptacle to facilitate easier, more calculated closure, and also to allow for ease of opening the cosmetic container when the receptacle and/or the cap are rotated or twisted by the user. As at least one of the components (receptacle or cap) is twisted, the at least one cam feature will come out of the at least one recess and be level with the abutment surface of the collar or a surface of the cap (depending on which component the cam feature is located) and cause the cap and receptacle to separate. Once removed from the recess, the cam feature will create a space or gap (e.g., a gap of approximately 1 mm) between the cap and the receptacle, which will make it easier for a user to pull the two components away from each other against the magnetic force of the magnetic sealing system.

In FIG. 5A, an exploded view of a rectangular cosmetic container 500, having a square cross-sectional shape is shown. Referring to all of FIGS. 5A through 5E, the container 500 has a receptacle 510 having a body 512 defining an interior volume (not seen), a collar 514 having an access 515 providing access to the interior volume, an abutment surface 516 and a wiper 518. The receptacle 510 includes, as part of the collar 514, a first magnetic portion 530 of a magnetic sealing system present on the abutment surface 516. As best seen in FIGS. 5B and 5C, the collar 514 has at least one receptacle 533 for a magnet, particularly, four receptacles 533*a*, 533*b*, 533*c*, 533*d*, each for a magnet, are present in the corners of the square shape.

The container 500 also has a cap 520 that is repeatedly removable and replaceable onto the receptacle 510 to provide access to (e.g., open), and to inhibit access to (e.g., close), the interior volume of the receptacle 510. The cap 520, in FIG. 5A, includes an outer cap 522, an inner cap 523, an applicator wand 524 and a plug 526. The cap 520 also includes a second magnetic portion 540 of a magnetic sealing system. As best seen in FIGS. 5D and 5E, the inner cap 523 has an abutment surface 546 having at least one receptacle 535 for a magnet, particularly, four receptacles 535*a*, 535*b*, 535*c*, 535*d*, each for a magnet, present in the corners of the square shaped inner cap 523.

The receptacle 510 and the cap 520 further include at least one cam feature 550 to facilitate the remove of the cap 520 from the receptacle 510. Seen in FIGS. 5D and 5E, the cap 520 includes two cam features 550*a*, 550*b*; in this particular example, the cam features 550 are bidirectional, each cam feature 550 having a first sloped surface 552*a* and a second sloped surface 552*b*. The sloped surfaces 552 are linear; in other implementations, the sloped surfaces of the cam feature may be non-linear. To provide a close seal between the abutment surface 516 of the receptacle 510 and the abutment surface 546 of the cap 520 when the magnetic portions 530, 540 are engaged, the collar 514 includes a recess 560, specifically a first recess 560*a* and a second recess 560*b* (FIGS. 5B and 5C) to receive the cam features 550*a*, 550*b* therein. There is at least one recess 560 for each cam feature 550. In the implementation of the container 500, there are two cam features 550 and two recesses 560 opposite each other; thus, the receptacle 510 and the cap 520 will sealing join at only two positions (e.g., 180 degrees from each other). In an alternate implementation, a receptacle and cap with four evenly spaced cam features and four evenly spaced recesses, at 90 degrees to each other, will sealing join at four positions (e.g., every 90 degrees).

To open the container 500, the cap 520 can merely be pulled axially away from the receptacle 510, as in other implementations, thus breaking the magnetic attraction between the magnets of the receptacle 510 and the cap 520. Preferably however, the cap 520 and/or the receptacle 510 are rotated in relation to the other, thus tangentially displacing the magnets of the receptacle 510 from the magnets of the cap 520 and decreasing the attraction between the magnets so that the cap 520 can be readily pulled away from the receptacle 510. Further rotation of the cap 520 and/or the receptacle 510 pushes the cap 520 and the receptacle 510 apart, as the sloped surface 552*a* or 552*b* of the cam features 550 slides out from the recess 560 to unseat the cam features 550 from the recess 560 and thus ride on the abutment surface 516.

FIGS. 6A through 6E show a cylindrical cosmetic container 600, having a circular cross-sectional shape. Similar to previous examples, the container 600 has a receptacle 610 having a body 612 defining an interior volume (not seen), a collar 614 having an access 615 providing access to the interior volume, an abutment surface 616, a neck 617 and a wiper 618. The receptacle 610 includes, as part of the collar 614 on the abutment surface 616, a first magnetic portion 630 of a magnetic sealing system. As best seen in FIG. 6A, the collar 614 has at least one magnet 632, in this implementation, one continuous annular magnet 632.

The container 600 also has a cap 620 that is repeatedly removable and replaceable onto the receptacle 610 to provide access to (e.g., open), and to inhibit access to (e.g., close), the interior volume of the receptacle 610. The cap 620, in FIG. 6A, includes an outer cap 622, an inner cap 623, an applicator wand 624 and a plug 626. The cap 620 also includes a second magnetic portion 640 of a magnetic sealing system. As best seen in FIG. 6A, the inner cap 623 has at least one magnet 642, particularly, one annular magnet 642 extending around the applicator 624 and the plug 626, seated in the inner cap 623.

The receptacle 610 and the cap 620 further include at least one cam feature to facilitate the remove of the cap 620 from the receptacle 610. Seen in FIGS. 6B and 6C, the collar 614 includes a bidirectional cam feature 650 having a first sloped surface 652*a* and a second sloped surface 652*b*. To provide a close seal between the magnet 632 and the magnet 642 when the magnetic seal is engaged, the cap 620 includes a recess 660 (FIGS. 6D and 6E) in the abutment surface 646 to receive the cam feature 650 therein. In the implementation of the container 600, there is only one cam feature 650 and one recess 660; thus, the receptacle 610 and the cap 620 will sealing join at only one position.

Similar to the container 500, to open the container 600, the cap 620 can merely be pulled axially away from the receptacle 610, as in other implementations, thus breaking the magnetic attraction between the magnets 632, 642. Preferably however, the cap 620 and/or the receptacle 610 are rotated in relation to the other, pushing the abutment surface 646 of the cap 620 and the abutment surface 616 of the receptacle 610 apart as the sloped surface 652*a* or 652*b* of the cam feature 650 slides out from the recess 660 to unseat the cam feature 650 from the recess 660.

FIGS. 7A through 7D show an implementation of a cylindrical container (having a circular cross-section) having more than one cam feature. FIGS. 7A and 7B show a collar 714 having at least one cam feature 750 on an abutment surface 716, particularly, four cam features 750, and FIGS. 7C and 7D show an inner cap 723 having at least one recess 760 in an abutment surface 746 for each cam feature 750.

FIGS. 8A through 8D show an alternate implementation of a cylindrical container (having a circular cross-section) having more than one cam feature. FIGS. 8A and 8B show a collar 814 having at least one cam feature 850, particularly, six cam features 850, in an abutment surface 816 and FIGS. 8C and 8D show an inner cap 823 having at least one recess 860 in an abutment surface 846 for each cam feature 850.

Referring to FIG. 9, an alternate implementation of a cosmetic container 900 is shown, the container 900 having a receptacle 910 and a cap 920 removable and replaceable from the receptacle 910 for providing and inhibiting access to the interior of the receptacle 910. Although not discernible from the view of FIG. 9, the receptacle 910 and the cap 920 may have a, e.g., rectangular (e.g., square) shape or a circular shape when viewed from the top or bottom of the container 900.

The receptacle 910 has a body 912 defining an interior volume 914 for receiving a product, e.g., a cosmetic, therein and includes an access 915 for providing access to the interior volume 914. The cap 920 includes a depending portion 924 than fits within the access 915. The receptacle 910 has a first magnetic portion 930 of a magnetic sealing system, and the cap 920 has second magnetic portion 940 of the magnetic sealing system. The magnetic portions 930, 940 are configured so that when the cap 920 is seated in and on the receptacle 910, the depending portion 924 of the cap 920 seats within the access 915 and into the interior volume 914 of the receptacle 910 (thus, the cap 920 is a male structure being received in the female receptacle 910). The first magnetic portion 930 and the second magnetic portion 940 of the magnetic sealing system releasably engage with each other, and together with other features, provide a fluid-tight seal between the receptacle 910 and the cap 920. In this particular implementation, the first magnetic portion 930 and the second magnetic portion 940 are each present on three abutting surfaces of their respective component. In other implementations, the magnetic portions 930, 940 may be present on two of the abutting surfaces or only on one of the abutting surfaces.

The first magnetic portion 930 and the second magnetic portion 940 of the container 900 may include any of the features described above in any of the previous container examples. For example, the container 900 may include at least one cam feature on one of the receptacle 910 or the cap 920 and at least one recess for each cam feature, the recess being on the other of the receptacle 910 and the cap 920. As another example, the first magnetic portion 930 and/or the second magnetic portion 940 may have one magnet (e.g., an annular magnet) or may have multiple magnets.

Although various specific examples and implementations of cosmetic containers have been shown and described, it is understood that the magnetic sealing system can be implemented in other containers. For example, the cap and the receptacle may have different cross-sectional shapes, e.g., circular receptacle with a square cap. As another example, the cap and receptacle may have a different overall diameter, e.g., the receptacle having a larger diameter than the cap.

FIG. 10 provides, in a stepwise manner, a method 1000 for closing a container having a magnetic sealing system, such as described above; particularly, the method 1000 provides for seating and sealing the first component and the second component. An operation 1002 aligns a first magnetic portion of a first component of a cosmetic container to an opposing second magnetic portion of a second component of the cosmetic container with opposite polarity. An operation 1004 aligns a cam feature in the first component to a recess in the second component. An operation 1006 slideably attaches the first component to the second component via magnetic forces between the first magnetic portion and the opposing second magnetic portion. An operation 1008 inserts the cam feature into the recess, thus seating and sealing the first component and the second component.

FIG. 11 provides, in a stepwise manner, a method 1100 for opening a container having a magnetic sealing system, such as described above. The method 1100 begins by having a sealed container, the container having a first component and a second component, with each of the first component and the second component having a magnetic portion of a magnetic sealing system. An operation 1102 rotates the first component with respect to the second component. An operation 1104 dislodges a cam feature in the first component out of a recess in the second component, e.g., toward a top surface of a collar. An operation 1106 disrupts the magnetic forces between the first magnetic portion and the opposing second magnetic portion. An operation 1108 separates the first component from the second component.

In some implementations, a first magnet of the first component may be aligned to a third magnet in the second component of same polarity responsive to rotating the first component with respect to the second component. Such orientation would further facilitate separating the first component from the second component.

FIG. 12 provides, in a stepwise manner, a method 1200 for closing a container having a magnetic sealing system, such as described above, the container having a cap with a male portion and a receptacle that receives the male portion; particularly, the method 1200 provides for sealing the cap and the receptacle. An operation 1202 aligns a male portion of the cap of a cosmetic container with an access aperture of the receptacle, the receptacle having a first magnetic portion around the access aperture and the cap having a second magnetic portion around the male portion. An operation 1204 inserts the male portion at least partially into the interior volume of the receptacle. An operation 1206 attaches the cap to the receptacle via magnetic forces between the first magnetic portion and the opposing second magnetic portion, thus providing a seal between the cap and the receptacle.

The above specification and examples provide a complete description of the structure and use of exemplary implementations of the invention. Since many implementations of the invention can be made without departing from the spirit and scope of the invention, the invention resides in the claims hereinafter appended. Furthermore, structural features of the different implementations may be combined in yet other implementations without departing from the recited claims. The above detailed description, therefore, is not to be taken in a limiting sense. While the present disclosure is not so limited, an appreciation of various aspects of the disclosure will be gained through a discussion of the examples provided.

Unless otherwise indicated, all numbers expressing feature sizes, amounts, and physical properties are to be understood as being modified by the term "about," whether or not the term "about" is immediately present. Accordingly, unless indicated to the contrary, any numerical parameters set forth are approximations that can vary depending upon the desired properties sought to be obtained by those skilled in the art utilizing the teachings disclosed herein.

As used herein, the singular forms "a", "an", and "the" encompass implementations having plural referents, unless the content clearly dictates otherwise. As used in this specification and the appended claims, the term "or" is generally employed in its sense including "and/or" unless the content clearly dictates otherwise.

Since many implementations of the invention can be made without departing from the spirit and scope of the invention, the invention resides in the claims hereinafter appended. Furthermore, structural features of the different implementations may be combined in yet another implementation without departing from the recited claims.

What is claimed is:

1. A container comprising:

a receptacle including an access aperture providing access to an interior volume, an abutment surface around the access aperture, and a first magnetic portion present on the abutment surface of the receptacle; and a cap having an abutment surface and configured to engage with the receptacle, the cap including a male portion extending from the cap receivable through the access aperture, the cap further including a second magnetic portion present around the male portion, the receptacle and the cap forming a seal to the interior volume when an attractive magnetic force between the first magnetic portion and the second magnetic portion pulls the abutment surfaces into contact, wherein one of the abutment surfaces includes at least one cam feature and the other abutment surface includes at least one recess for each cam feature in which to receive the at least one cam feature.

2. The container of claim 1, wherein the male portion includes an applicator wand extending from the cap and a plug on the applicator wand having a greater diameter than the applicator wand.

3. The container of claim 2, wherein the receptacle comprises a collar around the access aperture through which the applicator wand inserts into the interior volume, the plug and the collar forming the seal to the interior volume when the attractive magnetic force between the first magnetic portion and the second magnetic portion pulls the abutment surfaces into contact.

4. The container of claim 3, wherein the receptacle further comprises a wiper in the collar around the access aperture through which the applicator wand inserts into the interior volume.

5. The container of claim 1, wherein the first magnetic portion comprises an annular magnet around the access aperture and the second magnetic portion comprises an annular magnet.

6. The container of claim 1, wherein each of the first magnetic portion and the second magnetic portion comprises a plurality of individual magnets.

7. The container of claim 6, wherein each of the first magnetic portion and the second magnetic portion comprises four magnets.

8. The container of claim 1, wherein rotation of the cap in relation to the receptacle mechanically separates the abutment surface of the cap from the abutment surface of the receptacle.

9. The container of claim 1, wherein the abutment surface of the receptacle includes the at least one cam feature and the abutment surface of the cap includes the at least one recess for each cam feature.

10. The container of claim 1, wherein the abutment surface of the cap includes the at least one cam feature and the abutment surface of the receptacle includes the at least one recess for each cam feature.

11. The container of claim 1, wherein the cap and the receptacle form the seal when the abutment surface of the cap is held in contact with the abutment surface of the receptacle by the attractive magnetic force, wherein rotation of the cap in relation to the receptacle mechanically separates the abutment surface of the cap from the abutment surface of the receptacle, decreasing the attractive magnetic force between the first magnetic portion and the second magnetic portion and breaking the seal.

12. A method comprising:

aligning a male portion of a cap with an access aperture of a receptacle, the access aperture providing access to an interior volume of the receptacle, the receptacle having an abutment surface and a first magnetic portion around the access aperture and the cap having an abutment surface and a second opposing magnetic portion around the male portion, wherein one of the abutment surfaces includes at least one cam feature and the other abutment surface includes at least one recess for each cam feature in which to receive the at least one cam feature;

inserting the male portion at least partially into the interior volume;

receiving the at least one cam feature in the at least one recess; and attaching the cap to the receptacle via an attractive magnetic force between the first magnetic portion and the second magnetic portion to provide a seal between the cap and the receptacle.

13. The method of claim 12, wherein:

aligning the male portion of the cap comprises aligning an applicator wand of the cap with the access aperture; and inserting the male portion comprises inserting the applicator wand into the interior volume.

14. The method of claim 13, wherein:

aligning the applicator wand of the cap with a collar around the access aperture; and inserting the applicator wand into the interior volume through the collar.

15. The method of claim 14, wherein inserting the applicator wand into the interior volume comprises:

inserting the applicator wand into the interior volume through a wiper in the collar.

16. The method of claim 12 further comprising, after providing the seal:

rotating the cap with respect to the receptacle; and withdrawing the male portion from the interior volume.

17. The method of claim 12 further comprising, after providing the seal:

rotating the cap with respect to the receptacle to mechanically separate the cap and the receptacle, decreasing the attractive magnetic force between the first magnetic portion and the second magnetic portion and breaking the seal.

18. The method of claim 12 further comprising, after providing the seal:

rotating the cap with respect to the receptacle to remove the at least one cam feature from the at least one recess, mechanically separating the cap and the receptacle and breaking the seal.

19. A container comprising:

a receptacle having an access aperture with a wiper providing access to an interior volume of the receptacle, the receptacle further having a first magnetic portion at an abutment surface around the access aperture; and a cap having an abutment surface and configured to engage with the receptacle, the cap including an applicator wand extending from the cap receivable through the wiper and the access aperture, the cap further including a second magnetic portion present around the applicator wand, one of the abutment surfaces including at least one cam feature and the other abutment surface including at least one recess for each cam feature in which to receive the at least one cam feature, the receptacle and the cap forming a seal to the interior volume when an attractive magnetic force between the first magnetic portion and the second magnetic portion pulls the abutment surfaces into contact, wherein rotation of the cap in relation to the receptacle mechanically separates the abutment surface of the cap from the abutment surface of the receptacle, decreasing the attractive magnetic force between the first magnetic portion and the second magnetic portion and breaking the seal.

* * * * *